United States Patent [19]

MacGregor

[11] Patent Number: 4,760,951

[45] Date of Patent: Aug. 2, 1988

[54] DISPOSABLE SPRAY HOOD

[75] Inventor: Francis W. MacGregor, Simsbury, Conn.

[73] Assignee: Quad Research Inc., Avon, Conn.

[21] Appl. No.: 893,690

[22] Filed: Aug. 6, 1986

[51] Int. Cl.[4] ..... B65D 5/18; B65D 5/60; B05B 15/04

[52] U.S. Cl. ..... 229/125; 118/326; 118/DIG. 7; 134/200; 206/45.13; 220/405; 220/406; 229/148; 229/169; 229/178

[58] Field of Search ..... 220/405, 406, 403; 229/115, 125, 126, 130, 148, 154, 169, 178, 44 R; 206/555, 216, 233, 556, 45.13; 134/88, 182, 200; 118/326, DIG. 7

[56] References Cited

U.S. PATENT DOCUMENTS

| | | | |
|---|---|---|---|
| 1,530,644 | 3/1925 | Blandford | 229/148 |
| 1,719,681 | 7/1929 | Wiebusch | 206/565 |
| 1,916,119 | 6/1933 | Schwartz et al. | 229/154 |
| 2,336,731 | 12/1943 | Henderson | 229/44 R |
| 2,542,413 | 2/1951 | Ibsch, Jr. | 220/406 |
| 2,799,442 | 7/1957 | Van Rosen | 229/125 |
| 2,839,236 | 6/1958 | Dunning | 229/148 |
| 3,531,170 | 9/1970 | Boyer | 229/145 |
| 3,539,360 | 11/1970 | Wood | 220/403 |
| 3,590,500 | 7/1971 | Smith | 206/457 |

FOREIGN PATENT DOCUMENTS

| | | | |
|---|---|---|---|
| 879135 | 10/1961 | United Kingdom | 229/126 |

*Primary Examiner*—Stephen Marcus
*Assistant Examiner*—Gary E. Elkins
*Attorney, Agent, or Firm*—McCormick, Paulding & Huber

[57] ABSTRACT

A portable disposable spray hood for receiving an article to be spray coated and capturing overspray from an aerosol container type spray device used to spray coat the article is formed from a plurality of connected panels foldable relative to each other between a set-up position wherein the panels cooperate to define the hood and a collapsed position wherein the panels cooperate to form a shallow box containing a supply of disposable paper liners used to line the base portion of the hood in its set-up condition.

17 Claims, 1 Drawing Sheet

DISPOSABLE SPRAY HOOD

BACKGROUND OF THE INVENTION

This invention relates in general to hoods of the type used with spray coating apparatus to control overspray from the apparatus and deals more particularly with an improved disposable hood for controlling overspray from light duty spray coating applications utilizing non-toxic materials frequency sold in pressurized containers of the so called areosol type.

A large number of spray coating products such as spray-on adhesive, fixatives and colorants are presently being marketed in pressurized spray containers or aerosol bombs for home use. Products of the aforedescribed type, considered safe for indoor use in reasonable well ventilated areas and without provision for special exhaust equipment, are often used without provision for control of overspray. One common practice is to simply support the article to be sprayed on or against a sheet of disposable material, such as an old newspaper. Some of the overspray will, of course, be deposited on the newspaper. However, some of the matter entrained in the pressurized spray will inevitably enter room atmosphere. Such airborne material may be carried a considerable distance from the spraying site by moving air currents to be deposited on floor, wall and furniture surfaces as well as the surfaces of other items in the room.

It is the general aim of the present invention to provide a low cost disposable spray hood for controlling overspray from light duty, indoor spray applications uitilizing non-toxic spray materials to provide reasonable protection for surrounding surfaces, such as the surfaces of furniture, walls, carpeting and the like.

A further aim of the invention is to provide a durable light weight portable spray hood which may be made in various sizes and which is foldable to a collapsed position for convenient handling and storage.

Yet another aim of the invention is to provide a disposable hood assembly which includes at least one disposable liner for supporting an article to be spray coated and which liner may be conveniently removed from the hood for disposal upon completion of a spraying operation to expose another unsoiled liner for receiving the next article to be sprayed.

SUMMARY OF THE INVENTION

In accordance with the present invention, a disposable spray hood assembly for receiving an article to be spray coated and capturing overspray from a spraying device used to apply a coating to the article comprises a unitary structure which has a plurality of panels including rectangular bottom, front and rear panels and triangular side panels. Means is provided for connecting the front panel, the rear panel and the side panels to the bottom panel along associated edges of the bottom panel. Means is also provided for connecting each of the side panels to the back panel along an associated side edge of the back panel.

The panels are foldable relative to each other between set-up and collapsed positions. In the set-up position the panels cooperate to define a hood enclosure having a generally rectangular frontal opening defined by free edges of the front, back and side panels. The front panel is rearwardly and upwardly inclined relative to the bottom panel and has a free upper edge disposed a substantial distance rearwardly of the front edge of the bottom panel when the panels are in set-up position. Means is provided for releasably retaining the panels in the set-up position and includes cooperative engagement of the front panel with the side panels. The panels in the collapsed position are disposed in generally parallel relation to each other with the side panels between the bottom panel and the back panel. Associated portions of the front panel and the back panel are disposed in generally face-to-face relation to each other in the collapsed position and are retained in face-to-face relation to each other by fastener means.

DETAILED DESCRIPTION OF PREFERRED EMBODIMENT

Figure 1:
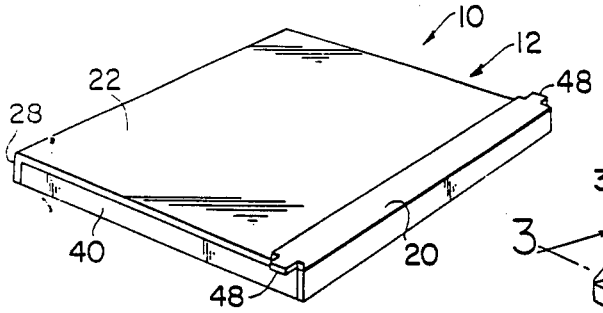
FIG. 1 is a perspective view of a disposable spray hood embodying the present invention shown in collapsed position.
Figure 2:
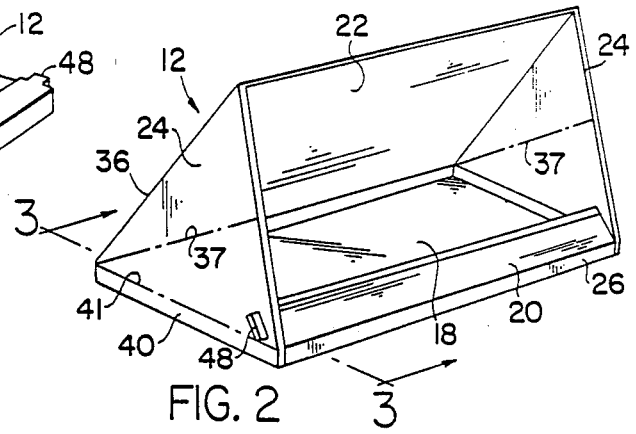
FIG. 2 is a perspective view of the spray hood of FIG. 1 shown in set-up position.
Figure 4:
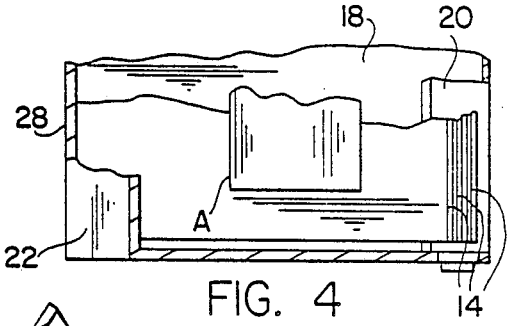
FIG. 4 is a sectional view taken along the line 4—4 of FIG. 3.
Figure 3:
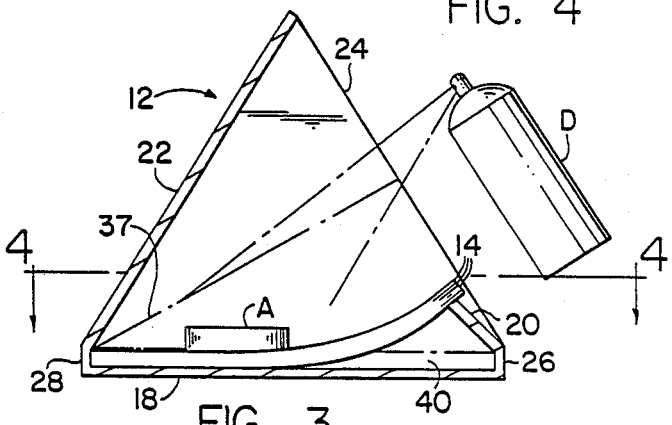
FIG. 3 is a somewhat enlarged sectional view taken along the line 3—3 of FIG. 2 and shows the hood with a supply of disposable liners positioned therein and an aerosol dispenser in spraying position relative to the hood.

Turning now to the drawing, a disposable spray hood assembly embodying the present invention is indicated generally by the reference numeral 10. The hood assembly 10 includes a disposable hood, indicated generally at 12, which has a collapsed position illustrated in FIG. 1 and a set-up position, best shown in FIGS. 2 and 3. The illustrated hood assembly also includes a supply of disposable sheet material liners which include at least one liner 14 for positioning in the hood to provide a clean surface upon which to support an article to be spray coated, such as the article A shown in FIGS. 3 and 4. The article A is shown in FIGS. 3 and 4 supported on a stack of disposable liners 14,14. In its collapsed position, the hood forms a container for holding the liners 14,14, as will be hereinafter discussed.

The illustrated hood assembly 10 is particularly adapted to capture overspray from an aerosol spray type spray device used to apply a coating of material to an article such as the article A. A typical aerosol dispenser is shown in spraying position in FIG. 3 and indicated generally by the letter D.

The collapsible spray hood assembly 10 is portable and particularly suited for studio-desktop use by artists, hobbyists and the like. The hood 12 may be made from any suitable inexpensive, durable, light-weight material, such as paper-board or the like, so that it may be discarded when it becomes contaminated. Preferably, and as shown, the hood 12 is formed from a single blank cut from a sheet of paperboard and has a plurality of integrally connected panels foldable relative to each other.

Figure 5:
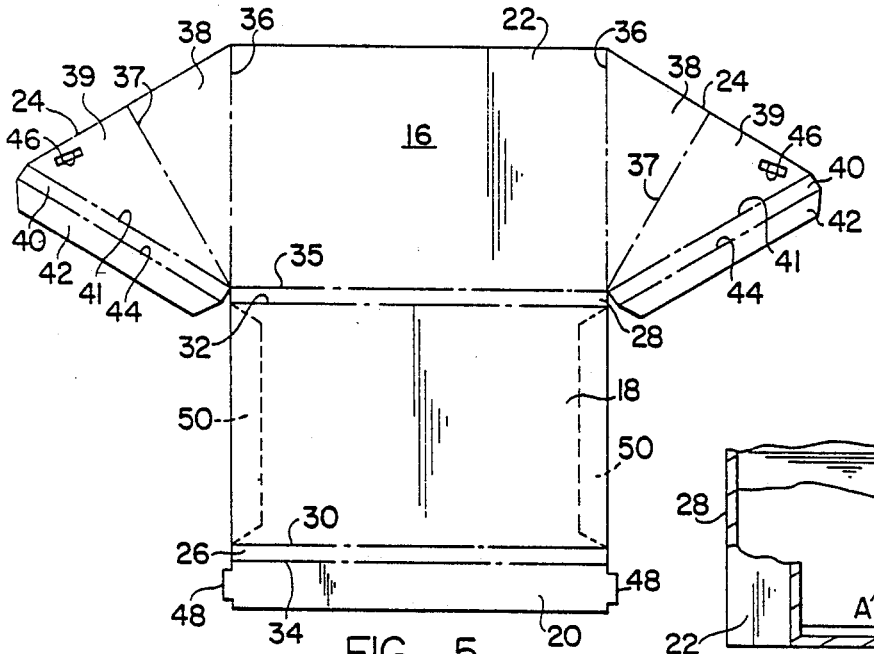
FIG. 5 is a plan view of a blank from which the disposable spray hood of FIGS. 1–4 is formed.

A paperboard blank used to form the illustrated hood 12 is indicated generally by the reference numeral 16 in FIG. 5 and has a plurality of panels which include a generally rectangular bottom panel 18, a generally rectangular front panel 20, a generally rectangular rear panel 22 and a pair of triangular side panels designated generally by the numerals 24,24.

In accordance with the presently preferred construction, the front and rear panels 20 and 22 are hingedly connected to the bottom panel by associated generally rectangular front and rear connecting panels 26 and 28 which are attached to and extend along the front and rear edges of the bottom panel 18. More specifically, the connecting panels 26 and 28 are connected to the bottom panel 18 along fold or scorelines indicated, respectively, at 30 and 32. The front panel 20 is connected to the connecting panel 26 along another fold line 34. Still another fold line 35 connects the rear panel 22 to the rear connecting panel 28. The triangular side panels 24,24 are each connected to an associated side edge of the rear panel 22 along an associated fold or scoreline 36. Preferably, and as shown, each triangular side panel 24 is equilateral and is bisected by an associated fold or scoreline 37 which divides the it into two triangular sections of substantially equal size indicated at 38 and 39, as shown in FIG. 5. Each side panel 24 carries an associated side connecting panel 40 which is connected to the side panel along a fold or scoreline 41. Each side connecting panel 40 has an associated connecting tab 42 attached to it along an associated fold or scoreline 44, substantially as shown. Each side panel section 39 has an associated slot 46 opening through it near the junction of its free edge and the fold line 41 and inclined inwardly and away from the later free edge substantially as shown in FIG. 5. The slots 46,46 are adapted to receive complimentary connecting tabs 48,48 formed on and projecting outwardly from opposite ends of the front panel 20.

In forming the hood 12 from the flat scored blank 16, as shown in FIG. 5, the connecting panels 42,42 are folded upwardly along the scorelines 44,44 to positions normal to the side panels 24,24. Thereafter, the side panels are folded upwardly and inwardly toward each other along the scorelines 36,36 to positions normal to the rear panel 22. The rear connecting panel 28 is then folded along the scoreline 32 to an upward position relative to the bottom panel 18. Thereafter, the rear panel 22 is folded forwardly along the scoreline 35 and to a forwardly and upwardly inclined position relative to the bottom panel 18 to bring the connecting panels 42,42 into overlying relation with associated side marginal portions of the bottom panel 18, the later marginal portions being indicated by broken lines on the bottom panel 18 and designated by the numerals 50,50. The lower surfaces of the connecting panels 42,42 are adhesively attached in face to face relation with the marginal portions 50,50.

Set-up of the hood 12 is completed by folding the front connecting panel 26 upwardly relative to the bottom panel 18 along the scoreline 30, folding the front panel 20 rearwardly along the scoreline 34 and engaging each connecting tab 48 within an associated slot 46. The side panels may be bowed outwardly away from each other to aid in engaging the connecting tabs 48,48 in the slots. The connecting tabs 48,48 cooperate with the slots 46,46 and the side panels 24,24 to releasably retain the hood 12 in its set-up position, as it appears in FIG. 2. It should be noted that in the set-up position the front panel 20 is upwardly and rearwardly inclined relative to the bottom panel 18, as best shown in FIGS. 2 and 3.

The liners 14,14 are preferably generally rectangular and substantially equal in size to the bottom panel 18. Thus, when a stack of liners 14,14 are positioned in the set-up hood 12, as shown in FIG. 3, the front edge portion of the stack rest on the upper edge of the front panel 20 and is disposed somewhat forward of the later upper edge so that the stack of flexible liners 14,14 will assume a position substantially as shown in FIG. 3 wherein at least a portion of each liner is forwardly and upwardly inclined relative to the bottom panel 18. The forward end of the stack of liners extend for some distance forward of the upper edge of the front panel 20 as best shown in FIG. 3.

An article to be spray coated, such as the article A, is positioned within the hood on the uppermost liner 14, as shown in FIG. 3. A spray apparatus, such as the aerosol dispenser D, is held substantially in the position shown in FIG. 3 so that the cone of pressurized gas with material entrained in it is directed into the hood and toward the article A resting on the liner 14. Some of the overspray, that is the spray material which is not deposited directly on the surface of the article is deposited directly on the surrounding surface of the supporting disposable liner 14. Other material entrained within the peripheral portion pressurized spray cone emitted from the dispenser D escapes into the atmosphere within the hood. Most if not all of this material will be deposited on the inner surfaces of the hood 12, that is the inner surfaces of the hood not covered by the liners 14,14.

Upon completion of the spraying operation the article A is removed from the hood. The soiled liner 14 may also be removed from the hood and discarded, exposing a clean liner to receive the next article to be sprayed.

After spraying operations have been completed, the hood 12 may be placed in its collapsed or storage position. However, when an adhesive or other tacky material has been sprayed, the hood should not be collapsed until all contaminated surfaces of the hood are throughly dry.

The hood 12 is collapsed by bowing the side panels 24,24 outwardly to release the tabs 48,48 from the slots 46,46. The front panel 20 is then folded forwardly along the scoreline 34 from its position between the side panels 24,24, as it appears in FIG. 2. The remaining liners 14,14 may now be positioned in overlying relation with the bottom panel 18, within the confinds of the front, rear and side connecting panels, 26,28 and 40,40. The side panels are then collapsed inwardly by folding each side panel along its associated scorelines 36, 37 and 41 which causes the rear panel 22 to fold to a position overlying the side panels 24,24 and wherein it is disposed in generally parallel relation to the bottom panel 18. The front panel may then fold rearwardly along the scoreline 34 and into overlying relation with a front marginal portion of the rear panel 22, as it appears in FIG. 1. A suitable fastener (not shown) may be provided for retaining the front panel 20 in overlying relation to the rear panel 22. The in hood 12 in its collapsed position of FIG. 1 forms a storage container for the supply of liners 14,14 contained within it.

It will now be noted that the connecting panels 26,28 and 40,40 extend upwardly relative to the bottom panel 18 both in the collapsed and set-up position of the hood 12. If desired, adjacent ends of the connecting panels may be joined together using suitable paper tape or the like so that the bottom panel 18 and the connecting panels 26,28 and 40,40 cooperate at all times to form a shallow container for receiving and containing a supply of disposable liners 14,14.

I claim:

1. A disposable hood assembly for receiving an article to be spray coated and capturing over-spray from a spraying device used to apply a coating to the article and comprising a plurality of panels including a rectangular bottom panel, a rectangular front panel, a rectangular rear panel, and triangular side panels, means for connecting said front panel, said rear panel, and said side panels to said bottom panel along associated edges of said bottom panel, means for connecting each of said side panels to said rear panel along an associated side edge of said rear panel, said panels being foldable relative to each other between set-up and collapsed positions, said panels in said set-up position cooperating to define a hood enclosure having a generally rectangular frontal opening defined by free edges of said front, rear and side panels, said front panel being rearwardly and upwardly inclined relative to said bottom panel and having a free upper edge disposed a substantial distance rearwardly of the front edge of said bottom panel in said set-up position, means for releasably retaining said panels in said set-up position including cooperative engagement of said front panel with said side panels, said panels in said collapsed position being disposed in generally parallel relation to each other with said side panels between said bottom panel and said rear panel, associated portions of said front panel and said rear panel being disposed in generally face-to-face relation to each other in said collapsed position.

2. A disposable hood asssembly as set forth in claim 1 wherein at least a portion of one of said panels including said front panel and said rear panel is disposed in overlying relation with an associated portion of the other of said panels including said front panel and said rear panel when said panels are in said collapsed position.

3. A disposable hood assembly as set forth in claim 1 wherein said means for releasably retaining said panels comprises means for releasably connecting one of said panels to another of said panels.

4. A disposable hood assembly as set forth in claim 3 wherein said means for releasably connecting one of said panels to another of said panels comprises a tab on said one panel received in a complementary slot in said other panel.

5. A disposable hood assembly as set forth in claim 1 wherein said means for connecting said front, rear and side panels to said bottom panel comprises rectangular connecting panels and said panels in said collapsed condition define a shallow generally rectangular box.

6. A disposable hood assembly as set forth in claim wherein said hood assembly includes at least one sheet of disposable lining material disposed within said box when said panels are in said collapsed position and providing a protective covering for said bottom panel when said panels are in said set-up position.

7. A disposable hood assembly as set forth in claim 6 wherein said lining material extends from the rear edge of said bottom panel to a position forward of said upper edge of said front panel and a portion of said lining material overlies an associated rear portion of said bottom panel when said panels are in said set-up position.

8. A disposable hood assembly as set forth in claim 1 wherein said panels are formed on a single blank of sheet material and separated from each other by score lines formed on the blank and comprising said connecting means.

9. A disposable hood assembly as set forth in claim 1 wherein said connecting means includes a tab connected to one of said panels along a fold line and adhesively attached to another of said panels.

10. A disposable hood assembly as set forth in claim 1 wherein said assembly includes at least one flexible generally rectangular disposable sheet material liner having a front to rear dimension substantially equal to the front to rear dimension of said bottom panel, said liner being disposed generally adjacent said bottom panel and between said bottom panel and associated portions of said side panels when said panels are in said collapsed position, said liner overlying an associated rear portion of said bottom panel and resting upon and extending forwardly beyond the free upper edge of said front panel when said panels are in said set-up position.

11. A disposable collapsible spray hood assembly as set forth in claim 10 wherein said means for releasably retaining said panels comprises means for releasably connecting one of said panels to another of said panels.

12. A disposable collapsible spray hood assembly as set forth in claim 11 wherein said means for releasably connecting said panels comprises a tab on said one panel received in an associated slot in another of said panels.

13. A disposable hood assembly as set forth in claim 1 wherein said triangular side panels comprise substantially equilateral triangles.

14. A disposable hood assembly as set forth in claim 1 wherein said triangular side panels each comprise a pair of triangular sections connected together to fold into face-to-face relation with each other when said panels are in said collapsed position.

15. A disposable hood assembly as set forth in claim 1 wherein said means for connecting said front panel to said bottom panel comprises a rectangular connecting panel.

16. A disposable hood assembly for receiving an article to be spray coated and capturing over-spray from a spraying device used to apply a coating to the article and comprising a unitary structure formed from a single sheet material blank and including a plurality of panels defined by said sheet material blank and separated from each other by score lines formed on said sheet material blank and including a rectangular bottom panel, a rectangular front panel, a rectangular rear panel, and triangular side panels, said rear panel being substantially equal in size to said bottom panel, means for connecting said front panel, said rear panel, and said side panels to said bottom panel along associated edges of said bottom panel, means for connecting each of said side panels to said rear panel along an associated side edge of said rear panel, said panels being foldable relative to each other between set-up and collapsed positions, said panels in said set-up position cooperating to define a hood enclosure having a generally rectangular frontal opening defined by free edges of said front, rear and side panels, said front panel being rearwardly and upwardly inclined relative to said bottom panel and having a free upper edge disposed a substantial distance rearwardly of the front edge of said bottom panel in said set-up position, said free edge of said rear panel being disposed above said bottom panel and in generally vertical alignment with a central portion of said bottom panel when said panels are in said set-up position and said bottom panel is in a horizontally disposed position, means for releasably retaining said panels in said set-up position including cooperative engagement of said front panel with said side panels, said panels in said collapsed position being disposed in generally parallel relation to each other with said side panels between said bottom panel and said rear panel, associated portions of said front panel and said rear panel being disposed in generally face-to-face relation to each other in said collapsed position, and fastener means for retaining said associated portions of said front and rear panels in face-to-face relation to each other in said collapsed position.

17. A disposable hood assembly for receiving an article to be spray coated and capturing over-spray from a spraying device used to apply a coating to the article and comprising a unitary structure formed from a single sheet material blank and including a plurality of panels defined by said sheet material blank and separated from each other by score lines formed on said sheet material blank and including a rectangular bottom panel, a rectangular front panel, a rectangular rear panel, and triangular side panels, said rear panel being substantially equal in size to said bottom panel, means for connecting said front panel, said rear panel, and said side panels to said bottom panel along associated edges of said bottom panel, means for connecting each of said side panels to said rear panel along an associated side edge of said rear panel, said panels being foldable relative to each other between set-up and collapsed positions, said panels in said set-up position cooperating to define a hood enclosure having a generally rectangular frontal opening defined by free edges of said front, rear and side panels, said front panel being rearwardly and upwardly inclined relative to said bottom panel and having a free upper edge disposed a substantial distance rearwardly of the front edge of said bottom panel in said set-up position, said free edge of said rear panel being disposed above said bottom panel and in generally vertical alignment with a central portion of said bottom panel when said panels are in said set-up position and said bottom panel is in a horizontally disposed position, means for releasably retaining said panels in set-up position including tabs on said front panel engaged with slots defined by said side panels and maintaining said front panel between and in engagement with said side panels, said panels in said collapsed position being disposed in generally parallel relation to each other with said side panels disposed between said bottom panel and said rear panel, associated portions of said front panel and said rear panel being disposed in generally face-to-face relation to each other in said collapsed position, at least one generally rectangular disposable sheet material liner having a front to rear dimension substantially equal to the front to rear dimension of said bottom panel, said liner being disposed generally adjacent said bottom panel and between said bottom panel and associated portions of said side panels when said panels are in said collapsed position, said liner overlying an associated rear portion of said bottom panel and resting upon and extending forwardly beyond the free upper edge of said front panel when said panels are in said set-up position, and fastener means for retaining said associated portions of said front and rear panels in face-to-face relation to each other in said collapsed position.

* * * * *